US006186433B1

(12) United States Patent
Kovacik et al.

(10) Patent No.: US 6,186,433 B1
(45) Date of Patent: Feb. 13, 2001

(54) MANUALLY WOUND CORD STORAGE UNIT

(75) Inventors: James D. Kovacik, Brecksville; Paul S. Blanch, Broadview Heights; Stanley E. Grzywna, Elyria, all of OH (US)

(73) Assignee: Alert Stamping & Mfg. Co., Inc, Bedford Heights, OH (US)

( * ) Notice: Under 35 U.S.C. 154(b), the term of this patent shall be extended for 0 days.

(21) Appl. No.: 09/325,306

(22) Filed: Jun. 3, 1999

(51) Int. Cl.[7] ..... B65H 75/00

(52) U.S. Cl. ..... 242/395; 242/406; 191/12.2 A

(58) Field of Search ..... 242/395, 406, 242/405.3; D8/359; 191/12.2 R, 12.2 A, 12.4; 137/355.27

(56) References Cited

U.S. PATENT DOCUMENTS

| | | | | |
|---|---|---|---|---|
| D. 374,166 | * | 10/1996 | Czerwinski et al. | D8/359 |
| D. 390,449 | * | 2/1998 | Whitehead et al. | D8/359 |
| D. 408,720 | * | 4/1999 | Sheng | D8/359 |
| 2,049,086 | * | 7/1936 | Shingleton | 242/406 |
| 2,856,470 | | 10/1958 | Hyde . | |
| 3,201,060 | * | 8/1965 | Bluhm et al. | 242/406 |
| 3,481,557 | * | 12/1969 | Miller | 242/405.3 |
| 3,536,275 | * | 10/1970 | Salomon | 242/406 |
| 3,880,378 | * | 4/1975 | Ballenger | 242/406 |
| 3,908,277 | | 9/1975 | Rutty . | |
| 4,061,290 | * | 12/1977 | Harrill | 242/405.3 |
| 4,133,416 | | 1/1979 | Deurloo . | |
| 4,244,536 | * | 1/1981 | Harrill | 242/405.3 |
| 4,406,422 | | 9/1983 | Philips . | |
| 4,506,698 | | 3/1985 | Garcia et al. . | |
| 4,512,361 | | 4/1985 | Tisbo et al. . | |
| 4,520,239 | * | 5/1985 | Schwartz | 242/395 |
| 4,777,976 | | 10/1988 | Johnson et al. . | |
| 5,014,925 | * | 5/1991 | Cump | 242/405.3 |

* cited by examiner

*Primary Examiner*—John M. Jillions
(74) *Attorney, Agent, or Firm*—MacMillan, Sobanski & Todd, LLC

(57) ABSTRACT

A manually wound cord storage apparatus comprising a reel frame having a central hub, a handle and at least two feet attached to a generally planar body. A spool for storing an electrical cord is rotatably mounted on the central hub. A winding knob is rotatably mounted on the spool for assisting the rotation of the spool around the central hub. The cord storage apparatus permits easy storage and transportation of an extension cord for supplying power to small appliances and electrical tools. The feet permit the apparatus to be used and stored in an upright position out of water and dirt.

12 Claims, 3 Drawing Sheets

MANUALLY WOUND CORD STORAGE UNIT

BACKGROUND OF THE INVENTION

The present invention relates generally to a storage reel for an electrical extension cord. More specifically, the present invention relates to a manually wound cord storage unit configured specifically for use with small appliances and electrically powered tools that supports an extension cord out of water and dirt and permits the cord to be easily rewound and stored after use.

Cord storage reels for storing and transporting electrical extension cords are known. Such reels consist basically of a spool on which the extension cord can be wound. In some cases, the spool is enclosed in a housing. Typically, a crank is connected to the spool so that the spool can be manually rotated to wind the extension cord thereabout. Such reels are particularly useful in industrial or commercial settings such as automobile repair shops, machine shops, carpentry shops and construction sites. They permit workers to readily access electrical power as needed for the operation of portable electric tools, test devices, and trouble lights at various locations remote from an existing power outlet. Such reels are also very convenient around the house and yard, particularly for use with electrically powered outdoor appliances like hedge trimmers, electric lawn mowers, edgers, and blowers that could potentially be used hundreds of feet from an electrical outlet. In addition, the use of extension spools makes it possible to use only pigtails, i.e. short electrical cords, on electrical tools and devices thereby simplifying the movement and storage of such tools and devices.

While exterior designs may vary, the most basic cord storage reels are not much more than a spool about which an extension cord can be wound or a spool mounted in a housing. Such devices having a crank to aid in turning the spool to rewind the extension cord are shown, for example, in the U.S. Pat. Nos. 2,856,470 and 4,244,536.

SUMMARY OF THE INVENTION

The present invention concerns a storage apparatus for an electrical extension cord configured specifically for use with small electrical appliances and tools.

The portable, manually wound cord storage apparatus of the present invention includes a reel frame having a central hub with a carrying handle and at least two feet connected to the central hub forming a cradle. A spool for storing an electrical cord is sized to fit in the cradle and is pivotally attached to the central hub. A winding knob is pivotally connected to the spool for assisting the rotation of the spool around the central hub. The cord storage apparatus permits easy storage and transportation of an extension cord for supplying power to small appliances and electrical tools. The feet permit the apparatus to be used and stored in an upright position out of water and dirt. The open cradle construction permits an easy visual check of how much extension cord remains on the reel.

One object of the invention is an apparatus on which an extension cord can be conveniently stored.

Another object of the invention is an apparatus from which an extension cord can be manually unwound and retracted to provide easy access to a desired amount of an extension cord as needed.

Still another object of the invention is an apparatus that will support an extension cord in a position removed from surface dirt and water.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
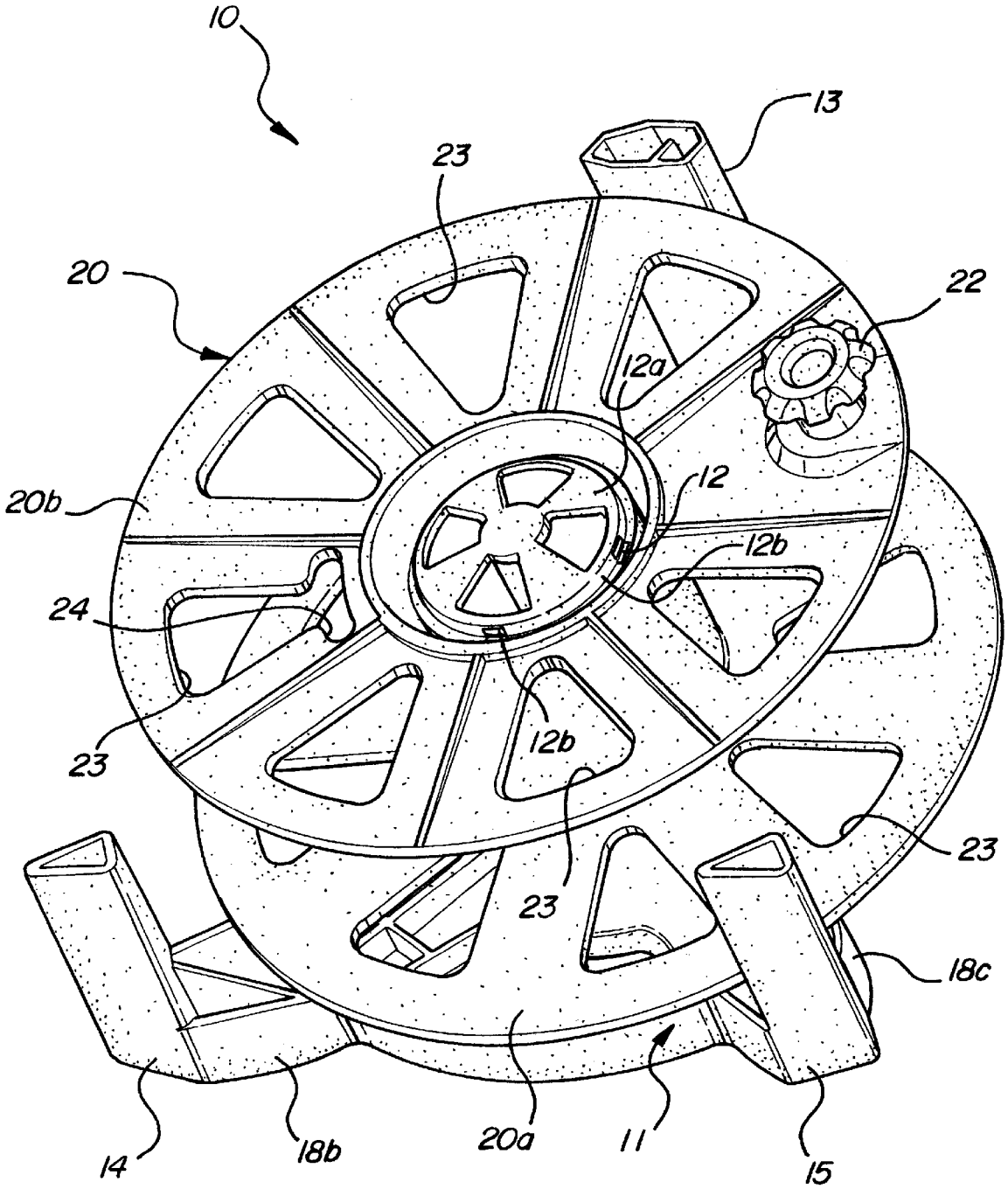
FIG. 1 is a perspective view of a manually wound cord apparatus in accordance with the present invention.
Figure 2:
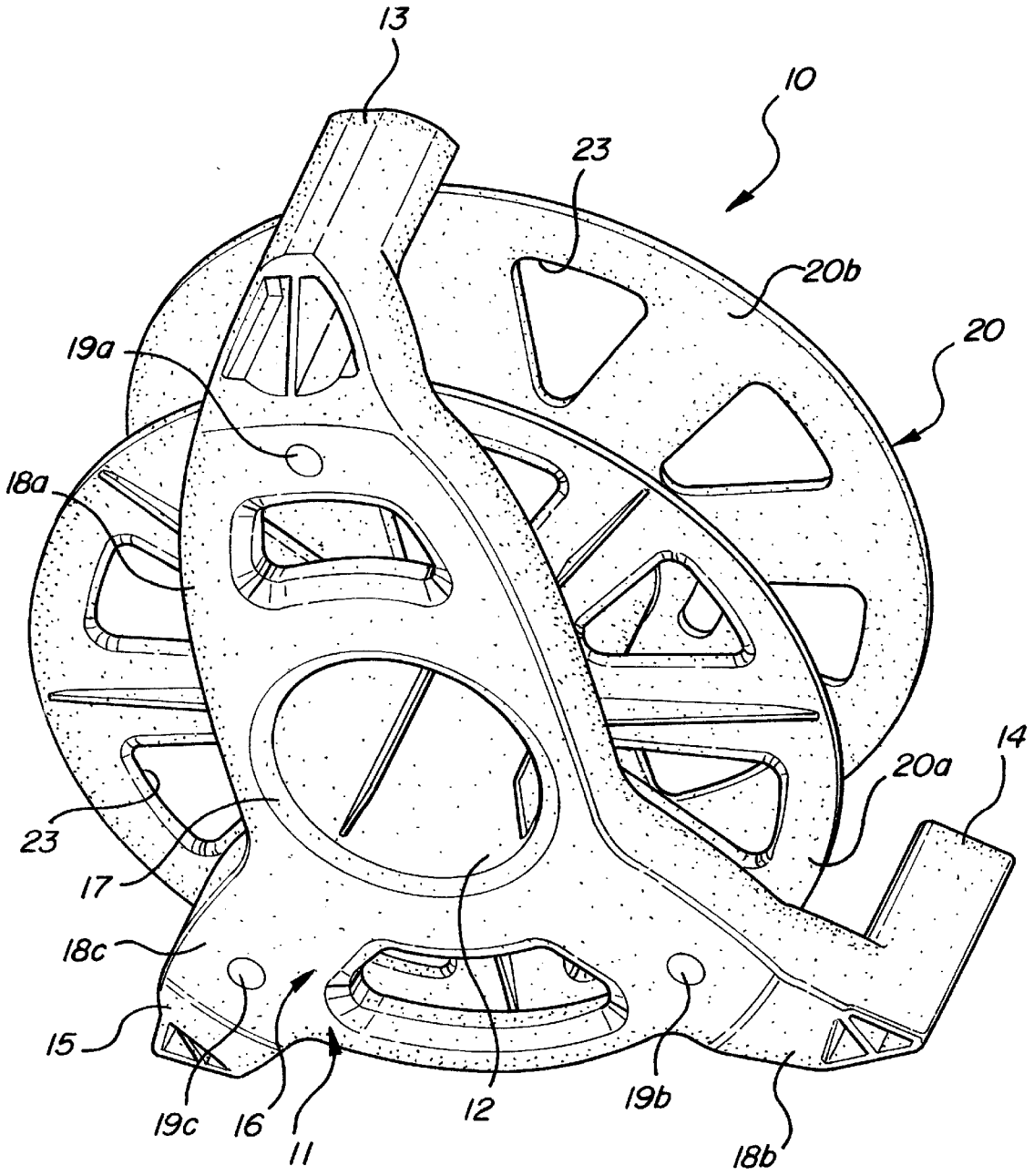
FIG. 2 is a perspective view from the opposite side of the apparatus shown in FIG. 1.
Figure 3:
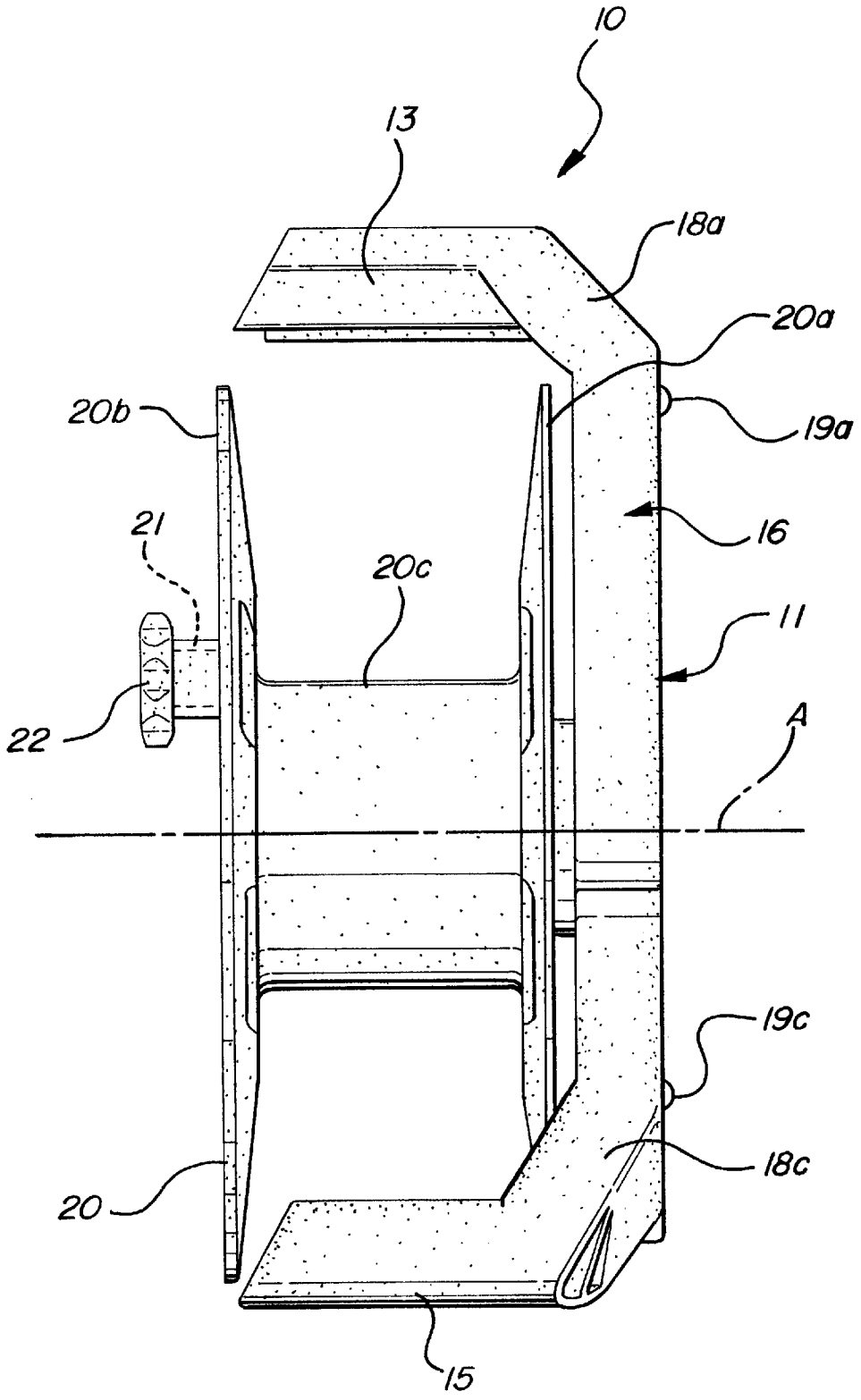
FIG. 3 is a side elevational view of the apparatus shown in the FIGS. 1 and 2.

There is shown in the FIGS. 1–3 a portable manually wound cord storage apparatus 10 including a reel frame 11 and a spool 20. The reel frame 11 has a central hub 12 of cylindrical shape open a one end and closed at an opposite end by a wall 12*a*. Positioned around the central hub 12 are a handle 13 and at least two feet 14, 15. The spool 20 is rotatably mounted to the central hub 12 and has a winding knob 22 that permits easy manual rotation of the spool 20 about the central hub 12. The apparatus 10 according to the invention permits convenient storage of an extension cord as well as permitting ready access to manually unwind or retracted a desired amount of an extension cord as needed.

The reel frame 11 consists of a generally planar body 16 having a central aperture 17 about which the projecting central hub 12 extends and radially extending legs 18*a*, 18*b* and 18*c*. A handle 13 is attached to an outer end of the leg 18*a* and extends generally parallel to a common axis A of the hub 12 and the aperture 17. A pair of feet 14, 15 are similarly attached to the outer ends of the legs 18*b* and 18*c* respectively and also extend parallel to the common axis A. (While the invention is illustrated with two feet 14, 15, these two feet may be connected by a single piece of material to form a broad support platform, or three, four, or more feet may be attached to the planar surface 16 to support the frame.) The handle 13 permits the apparatus 11 to be hand carried and the feet 14, 15 permit the apparatus to be rested on a generally horizontal surface. In the illustrated configuration, the handle 13 is located diametrically opposite a midpoint between the two feet 14, 15 which are closer together than they are to the handle.

The feet 14, 15 are configured to provide a broad base of support for the cord storage apparatus 10 such that the axis of rotation of the spool 20 is parallel to the surface that the feet 14, 15 are resting on. The feet 14, 15 support an extension cord wound on an apparatus of the invention in a position removed from surface dirt and water. If it is desired to rest the apparatus 10 on its side, a plurality of generally hemispherical supports are provided on the surface of the body 16 facing away from the spool 20. A support 19*a* extends outwardly from the leg 18*a*, a support 19*b* extends outwardly from the leg 18*b* and a support 19*c* extends outwardly from the leg 18*c*. The supports will contact the supporting surface and space the apparatus 10 thereabove.

The spool 20 comprises a generally tubular central portion 20*c* connected between a first side 20*a* and a second side 20*b* of the spool as shown in FIG. 3. The first side 20*a* and the second side 20*b* of the spool are substantially mirror images of each other. A hollow interior of the central portion 20*c* is sized to accept the central hub 12 so that the spool 20 can be freely rotated in either direction around the common axis A.

A plurality of radially extending retainers 12*b* are formed on the central hub 12 adjacent the end wall 12*a*. The retainers 12*b* extend outwardly a distance greater than the interior diameter of the central portion 20*c*. The retainers 12*b* are chamfered adjacent the end wall 12*a* to permit assembly of the spool 20 onto the hub 12 but prevent removal of the spool with an interference once the spool has been forced past the retainers. When the spool 20 is mounted on the central hub 12 the outer surface of the first side 20*a* of the spool faces the body 16 of the reel frame 11 and the outer surface of the second side 20*b* of the spool faces away from the reel frame 11. Thus, the outer surface of the first side 20*a* is obstructed by the reel frame 11 and outer surface of the second side 20*b* is unobstructed. This configuration permits the winding knob 22 to be mounted on an axle 21 extending from the outward facing surface 20*b* of the spool. The winding knob 22 is rotatably mounted adjacent a periphery of the second side 20*b* of the spool 20 such that the spool 20 itself acts as a crank to provide added leverage to permit rapid rewinding of an extension cord onto the spool. The outer end of the axle 21 has a small radially extending flange formed thereon which functions to retain the knob 22.

In order to reduce weight as well as permit easy visualization of the amount of extension cord wound on the spool, a plurality of slots or openings 23 may be formed in one or both sides 20*a*, 20*b* of the spool 20. Formed in conjunction with one slot on the outer side 20*b* of the spool 20 is a cord connector opening 24. The cord connector opening 24 permits the male or female connector (depending on which end of the extension cord is being wound first onto the spool 20) to extend outside the spool 20. This permits access to the connector at the end of the cord that is wound first onto the spool 20 so that the cord may be used when it is only partially unwound. It also serves to retain the connector at the other end of the cord when it is wound on the spool.

The cord storage apparatus 10 according to the present invention is intended to be used with a standard electrical extension cord or cords for connection between a source of power, such as a wall outlet, and an electrical device. The apparatus of the invention can be sized to hold standard lengths or combinations of standard lengths of various gauges of extension cords having appropriate electrical connectors at either end.

A cord storage apparatus 10 is prepared for use by winding an extension cord on the spool 20. This is accomplished by placing the connector at one end of the extension cord between the sides of the spool 20*a*, 20*b* and through the cord connection opening 24. Several turns of extension cord are then made around to spool to secure the end in place. Once the end of the cord is fixed in place, the user holds the handle 13 of the cord storage apparatus 10 in one hand and places the other hand on the winding knob 22. The winding knob can then be used to rotate the spool 20 and rapidly wind the length of the extension cord onto the spool 20. Alternatively, the user may anchor the cord storage apparatus 10 on the ground by applying pressure against the handle 13 using one hand and operating the winding knob 22 with the other.

Whether the connector that extends through the cord connection opening 24 is the female connector or the male connector is completely at the discretion of the user. If for example, one is using a circular saw on a roof and the extension cord on the cord storage apparatus 10 is being used to connect the circular saw to an electrical outlet on the ground, it might be most convenient to extend the male connection of the extension cord through the cord connection opening 24 such that the cord storage apparatus 10 remains on the ground close to the electrical outlet. On the other hand, if one is using a variety of power tools to build a dock, for example, a desire to avoid the presence of loops of excess cord that could accidentally fall into the water might make it most convenient to extend the female connection through the cord opening 24 to permit such cord as needed to be wound and unwound from the cord storage apparatus 10.

The reel frame 11 and the spool 20 are formed of a suitable material such as molded ABS or polycarbonate flame-retardant plastic.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A portable manually wound cord storage apparatus comprising:

a reel frame including a generally planar body, a central hub, a handle and at least two feet formed as an integral unit, said body having a central aperture, said hub extending about said aperture and axially outwardly from said body, said body having a plurality of legs extending radially away from said aperture, said handle and said feet being attached to associated ones of said legs and extending generally parallel to an axis of said hub;

a spool for storing an electrical cord, said spool having a hollow interior accepting said hub whereby said spool is rotatably mounted on said hub with said handle and said feet spaced about a periphery of said spool;

a plurality of radially extending retainers formed on said hub and configured to permit installation of said spool on said hub and prevent removal of said spool from said hub; and a winding knob rotatably mounted on said spool for rotating said spool on said hub by hand.

2. The apparatus according to claim 1 wherein said reel frame has two of said feet.

3. The apparatus according to claim 2 wherein said handle is positioned at a point diametrically opposite a midpoint between said two feet.

4. The apparatus according to claim 1 wherein said winding knob is mounted adjacent an outer edge of said spool.

5. The apparatus according to claim 1 wherein said reel frame and said spool are fabricated from a plastic material.

6. The apparatus according to claim 5 wherein said plastic material is one of an ABS plastic and a polycarbonate plastic.

7. The apparatus according to claim 1 wherein said spool includes a generally tubular central portion forming said hollow interior and having a first side facing said reel frame attached to one end of said central portion and a second side attached to an opposite end of said central portion.

8. The apparatus according to claim 7 including a cord connector opening formed through said second side.

9. The apparatus according to claim 7 including a plurality of openings formed through said first side and said second side.

10. The apparatus according to claim 1 including a plurality of hemispherical supports extending from said legs in a direction opposite said hub.

11. A portable manually wound cord storage apparatus comprising:

a reel frame formed of a plastic material including a generally planar body, a central hub, a handle and two feet formed as an integral unit, said body having a central aperture, said hub extending about said aperture and axially outwardly from said body, said body having three legs extending radially away from said aperture, said handle and said feet being attached to associated ones of said legs and extending generally parallel to an axis of said hub;

a spool for storing an electrical cord, said spool having a hollow interior accepting said hub whereby said spool is rotatably mounted on said hub with said handle and said feet spaced about a periphery of said spool;

a plurality of radially extending retainers formed on said hub and configured to permit installation of said spool on said hub and prevent removal of said spool from said hub; and a winding knob rotatably mounted on said spool for rotating said spool on said hub by hand.

12. A portable manually wound cord storage apparatus comprising:

a reel frame including a generally planar body, a central hub, a handle and at least two feet formed as an integral unit, said body having a central aperture, said hub extending about said aperture and axially outwardly from said body, said body having a plurality of legs extending radially away from said aperture, said handle and said feet being attached to associated ones of said legs and extending generally parallel to an axis of said hub, and a plurality of hemispherical supports extending from said legs in an axial direction opposite said hub;

a spool for storing an electrical cord, said spool having a hollow interior accepting said hub whereby said spool is rotatably mounted on said hub with said handle and said feet spaced about a periphery of said spool;

a plurality of radially extending retainers formed on said hub and configured to permit installation of said spool on said hub and prevent removal of said spool from said hub; and a winding knob rotatably mounted on said spool for rotating said spool on said hub by hand.

* * * * *